United States Patent [19]

Beveridge

[11] Patent Number: 4,533,794

[45] Date of Patent: Aug. 6, 1985

[54] ELECTRODE FOR ELECTROSTATIC TRANSDUCER

[76] Inventor: Harold N. Beveridge, 1544 Knoll Circle Dr., Santa Barbara, Calif. 93103

[21] Appl. No.: 497,297

[22] Filed: May 23, 1983

[51] Int. Cl.[3] ..... H04R 19/00

[52] U.S. Cl. ..... 179/111 R; 179/131; 179/132; 179/141; 29/594

[58] Field of Search ..... 179/111 R, 111 E, 131, 179/132, 139, 140; 29/25.35, 25.41, 25.42, 594

[56] References Cited

U.S. PATENT DOCUMENTS

| | | | |
|---|---|---|---|
| 3,136,867 | 6/1964 | Brettell | 179/111 R |
| 3,894,333 | 7/1975 | Chang | 29/594 |
| 3,908,098 | 9/1975 | Kawakami et al. | 179/111 R |
| 3,941,946 | 3/1976 | Kawakami et al. | 179/111 R |
| 4,188,513 | 2/1980 | Morrell et al. | 179/111 E |
| 4,246,448 | 1/1981 | Tam et al. | 179/111 R |
| 4,383,139 | 5/1983 | Kanchev | 179/111 R |

FOREIGN PATENT DOCUMENTS

| | | | |
|---|---|---|---|
| 53-23618 | 3/1978 | Japan | 179/111 R |
| 57-44400 | 3/1982 | Japan | 179/111 R |
| 1239658 | 7/1971 | United Kingdom | 179/111 R |

*Primary Examiner*—Gene Z. Rubinson
*Assistant Examiner*—Danita R. Byrd
*Attorney, Agent, or Firm*—Griffin, Branigan, & Butler

[57] ABSTRACT

An electrode (13) has a nonconductive substrate (15) and a conductive layer (16) having a first plurality of holes (18) applied to the substrate which is then coated with a dielectric layer (20) wherein the dielectric layer has a relatively low resistivity (e.g. $10^{11}$ ohm cm). A second and third plurality of holes (700,710), concentric with but of smaller diameter than the first plurality of holes (18), are formed through the dielectric layer (20) and the nonconductive substrate (15), thereby providing a recess spacing (19) between the conductive layer holes (18) and the holes (700,710). In one embodiment of an electrostatic transducer (11), two electrodes (13) are spaced from a diaphragm (12) positioned therebetween. An electrostatic transducer (40) having multiple diaphragms (12,21) is made by incorporating two types of electrodes (13,28). One type of electrode (13) has one side of a nonconductive substrate (15) coated with a conductor (16) and a dielectric layer (20). The other type of electrode (28) has two sides of a nonconductive substrate (17) coated first with a conductive layer (60,61) and then with a dielectric layer (100,101).

23 Claims, 10 Drawing Figures

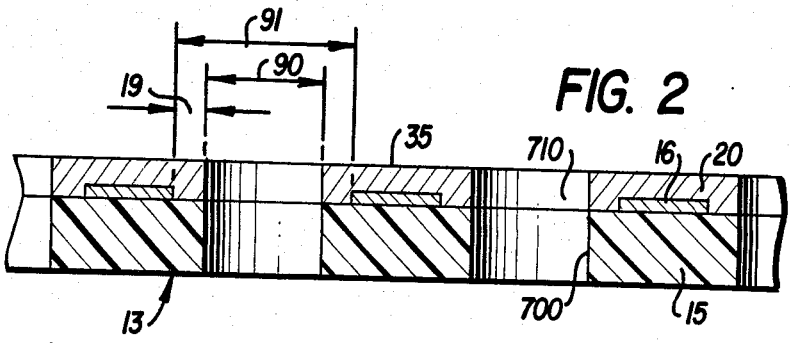
FIG. 2
FIG. 3
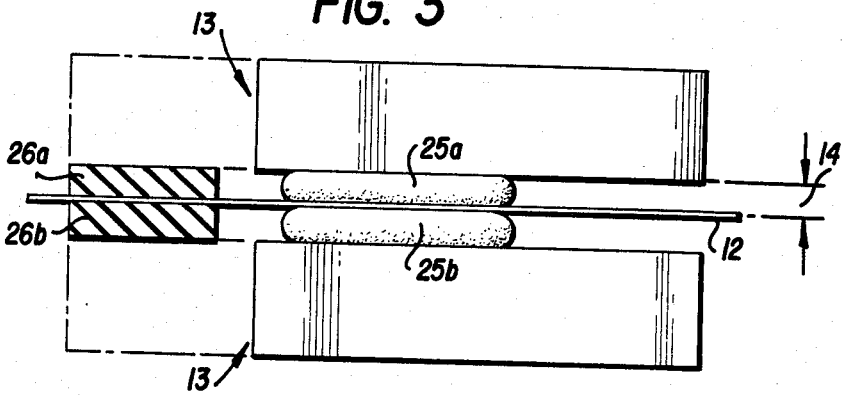
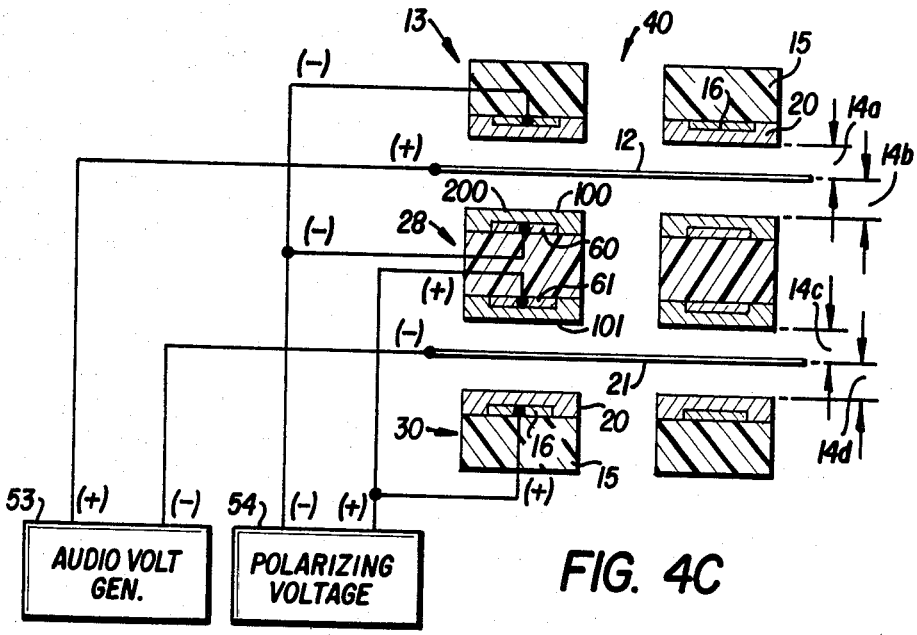
FIG. 4C

ELECTRODE FOR ELECTROSTATIC TRANSDUCER

BACKGROUND OF THE INVENTION

The invention relates to acoustic transducers such as generally used in high fidelity sound reproduction systems. More specifically, the invention relates to electrostatic or capacitive audio speakers.

Electrostatic speakers are generally of two broad design types. The simplest is a constant voltage design whereby a very thin and tightly stretched diaphragm is placed between two perforated electrodes maintained at constant high voltage. The diaphragm has a conductive coating on each side and receives audio voltage. An air gap is provided between the diaphragm and the electrodes. The sound generated by the diaphragm is transmitted through the air gap and radiates from the open perforations in the electrodes.

Another broad design type for electrostatic speakers includes perforated electrodes that are at a D.C. ground voltage with audio signals applied 180° out of phase and having a tightly stretched diaphragm placed therebetween. The diaphragm has a high resistance coating on each side so that a high D.C. voltage is applied through the large resistance resulting in a constant charge. Two high voltage drive points are required with the constant charge electrostatic speaker design. Only one drive point is required for the constant voltage design In the design of an electrostatic speaker, certain parameters must be considered. Diaphragm displacement varies greatly with the frequency of the impressed audio signal. For constant radiated audio power, diaphragm is inversely proportional to the square of the impressed audio frequency. At 20 Hz, displacement is $10^6$ times greater than at 20 KHz. If for 20 Hz displacement is, for example, 0.1 inches, then at 20 KHz, the displacement would be 0.0000001 inches. At 100 Hz, the displacement would be only 0.004 inches. This displacement is small compared with nearly all the air gap spacing commonly used in electrostatic speakers. Thus, if one is not interested in frequencies below about 100 Hz, the constant charge design and the simple constant voltage design are both suitable.

Powerful amplifiers are required to drive electrostatic transducers. The power required is proportional to the air gap spacing. For maximum output, the transducer operates at a voltage gradient as large as the air in the air gap will withstand without corona or sparking. Thus to minimize the power required, the air gap should be made as small as possible.

The maximum acoustic power available from an electrostatic transducer is limited by the dielectric strength of air. Between the diaphragm and the electrodes, with a 50 mil spacing, a corona will occur at about 5000 volts. This is a gradient of 100 V/mil. Many dielectric materials in thicknesses of a few mils will withstand 5000 V/mil for short time voltage applied. This is about 50 times what air will withstand. For continuous voltage application, many dielectrics will withstand 500 V/mil. This is about 5 times what air will withstand.

Diaphragms in electrostatic transducers are nearly always made of thin plastic film (less than 1 mil). Even a small speak will burn a hole in the film. Electrode design must preclude any sparking at all. This can be achieved by two presently employed techniques. In one technique, the electrode conductors are jacketed by insulation. In a second technique, a relatively thick nonconductive electrode substrate is coated with a conductive coating and a relatively large distance between the diaphragm and the conductive coating on the electrode is provided.

With regard to insulation on electrodes, most common dielectric materials used for electrode insulation have a volume resistivity lying in the range of $10^{14}$ to $10^{17}$ ohms cm. A capacitor made employing such dielectric materials retain its charge for minutes. A difficultly arises when such material is used for insulation on wires or plates to be used as electrodes in electrostatic transducers. When momentary overload voltage gradients in the air gap reach corona level, the charge transfer deposits on the dielectric surface and remains there for some time. This results in reducing the polarizing voltage and reduces the audio output with concurrent sound distortion. As the charge leaks away through the dielectric, the audio output returns to normal.

If the dielectric used in the electrode would have a voltage resistivity of no more than about $10^{11}$ ohm cm, about $10^4$ times lower than most insulators, the recovery time would be only about 0.1 seconds, short enough to completely eliminate the problem of recovery time and the concurrent audio distortion. A present technique to reduce the volume resistivity of a dielectric material to $10^{11}$ ohm cm involves adding carbon to an epoxy electrode. However, volume resistivity is hard to control by this method and very sensitive to the amount of carbon present, the mixing time, and other factors. In addition, this material has the undesirable property of being nonlinear; that is, the current through the material is proportional to the square of the applied voltage, and thus the current is not linearly proportional to the voltage applied.

Present designs for electrode structures for electrostatic transducers are of five general types. One present electrode structure employs an insulated wire strung back and forth across a framework providing space between the wires to allow sound to pass through. A second present electrode consists simply of a flat metal sheet with holes in it to allow sound to pass through. A third electrode is simply a flat metal sheet coated with a layer of insulation material. Another present electrode structure is comprised of a sheet of insulating material perforated with a plurality of holes and coated on the outer side with a conductive coating. Finally, another present electrode structure is comprised of a series of relatively thick dielectric bars having a relatively high dielectric constant K and a relatively low volume resistivity. A conductive coating is applied to the outer edges of the dielectric bars.

The insulated wire electrode has poor transient voltage overload recovery and poor performance with a small air gap. The perforated metal electrode is particularly in its resistance to sparking. The perforated metal electrode coated with a dielectric performs poorly with a small air gap, has poor transient voltage overload recovery, and poor resistance to sparking. The electrode comprised of a perforated dielectric with a conductive coating on the outer side has poor resistance to sparking and poor transient voltage overload recovery. The electrode having thick bars of relatively high dielectric constant K and relatively low volume resistivity has excellent transient voltage overload recovery, good spark-free performance, and performs well with a small air gap.

None of the present electrode structures, however, are suitable for speaker designs employing multiple diaphragms. The limited sound pressure available from an electrostatic transducer can be increased markedly by using two or more closely spaced diaphragms suitably driven. Even though the concept of multiple diaphragm transducers has been known for more than 20 years, this method has not been successfully commercialized. If two diaphragms are driven in phase and are to remain in phase at the highest audio frequencies without the need for complicated time-delay electronic circuitry, the spacing between them must be small, on the order of 0.1–0.2 inches. In the actual construction of prior art multiple diaphragm transducers, however, the actual spacing is greater than 0.1–0.2 inches; and time-delay electronic circuitry including complex capacitance and inductance networks is necessary to compensate for an out of phase series of wavefronts presented by a series of diaphragms driven in phase but separated by a larger space.

An insulated wire does not mechanically lend itself to a double diaphragm transducer. A perforated metal or perforated metal coated with a dielectric could be used in a double diaphragm transducer, but acoustic performance would not be good. It would not appear to be possible to fabricate a double diaphragm electrostatic audio transducer from a perforated dielectric having one side coated conductively or using a thick/high-K/high-conductivity electrode having a conductive coating on one side.

Accordingly, it is a primary object of the present invention to provide an electrode for an electrostatic audio transducer having spark free performance.

Another advantage of the present invention is the provision of an electrostatic electrode having rapid recovery from transient electrical overloads.

Another advantage of the present electrostatic electrode is the provision of a uniform electric field.

Another advantage of the present electrostatic electrode is the provision of small air gap spacing between the electrode and the diaphragm.

Another advantage of the electrostatic electrode of the invention is the provision of an electrostatic transducer having multiple diaphragms.

Another advantage of the present invention is the provision of a multiple-diaphragm electrostatic transducer including electrodes having conductors which are capable of being electrically connected in accordance with a plurality of hook-up configurations.

Another advantage of the present invention is the provision of a multiple diaphragm transducer whose multiple diaphragms may be driven in phase without the need for complexity time-delay circuitry to compensate for out of phase wavefronts.

Another advantage of the present invention is the provision of an electrostatic electrode having a volume resistivity of about $10^{11}$ ohm cm and having a linear relationship between current and applied voltage.

Another advantage of the electrostatic electrode of the invention is the provision of an electrode capable of being laminated, non-hygroscopic, and having a dielectric constant of about 10.

SUMMARY OF THE INVENTION

An improved electrostatic electrode is provided for use in an electrostatic or capacitive audio transducer. The electrostatic electrode is comprised of a planar nonconductive member having a plurality of holes for transmission of audio signals; a conductive layer on a first side of the first planar member; and, a dielectric layer covering the first side of the first planar member to sandwich the conductive layer between the first planar member and the dielectric layer. The dielectric layer covering the conductive layer has a volume resistivity of no more than about $10^{11}$ ohm cm.

Preferably, the dielectric material is a polyamide material such as nylon, and the thickness of the dielectric layer is in the range of 3–15 mils, preferably 10 mils.

In one embodiment, the conductive layer is a layer of metal such as copper. The conductive layer is preferably recessed from and not in contact with the holes in the planar member.

In a further aspect of the invention, in accordance with its objects and purposes, a novel electrode for an electrostatic transducer is provided having two conductive surfaces. A nonconductive first planar member having a plurality of holes therein is coated on both planar sides with a conductive layer such as copper. A dielectric layer, such as the polyamide nylon, is applied to each side of the copper. In this way, an electrode is obtained which has a first dielectric layer, a first copper laminate layer, a nonconductive planar member substrate, a second copper layer, and a second dielectric layer.

In an additional aspect of the invention, in accordance with its objects and purposes, a novel electrostatic audio transducer is provided employing the novel electrodes of the invention. The novel transducer is comprised of first and second novel electrodes of the invention and a thin audio signal generating diaphragm positioned therebetween. An elastomeric adhesive is used to both provide an air gap between the diaphragm and the first and second electrodes and to bond the diaphragm to the electrodes. Preferably, the diaphragm is plastic sheet such as Mylar which is a polyethylene terephthalate of the Du Pont Co. The diaphragm has an aluminized coating on both sides. The preferred elastomeric adhesive is a silicone rubber composition which is electrically nonconductive.

In implementing an electrostatic audio transducer in accordance with the invention, conventional means are employed for charging the electrodes thereby creating an electric field between the electrodes and the diaphragm. Conventional means are also used for applying audio frequency electrical signals to the diaphragm.

In another aspect of the invention, an electrostatic audio transducer is provided having multiple diaphragms. A first electrode in accordance with the invention is provided, and a first diaphragm is spaced therefrom by a suitable air gap. Spaced from the first diaphragm by a suitable air gap is a electrode made in accordance with the invention having a conductive layer and a dielectric outer layer on each side. Spaced from the double sided electrode is a second diaphragm, and spaced from the second diaphragm in another electrode made in accordance with the invention having one side coated with a conductive layer and dielectric material. In accordance with the principles of the invention, multiple diaphragms and electrodes are spaced closely enough so that multiple diaphragms which are driven in phase produce wavefronts which are also in phase. Thus, there is no need for complex time-delay circuitry to compensate for out of phase wavefronts.

In accordance with another aspect of the invention, a method for fabricating a novel electrode of the invention is provided. In the method, a conventional nonconductive substrate, such as those used in making printed circuit boards, is printed with a conductive layer such as copper and etched in a pattern to remove the copper in areas where holes will be later formed. The copper-free areas are made larger than the size of the holes to be formed. A layer of dielectric material such as the polyamide nylon is applied over the previously etched copper layered nonconductive substrate. Concentric holes of smaller diameter than the holes in the copper coating are formed through the dielectric layer and the nonconductive substrate underneath. In this way, both a layer of dielectric coating and a layer of nonconductive substrate are situated between the copper layer and the formed holes. The concentric sets of hole may be in a variety of geometrical shapes, and the shape or shapes selected are chosen on the basis of desired audio properties. Suitable shapes for holes may include, for example, circles, squares, triangles, ellipses, or slits. The holes may be formed by automated drilling or by punching or other suitable and well-known techniques.

In accordance with another aspect of the invention, it has been discovered that fabrication of an electrostatic audio transducer employing a novel electrode of the invention is facilitated by a novel fabrication technique. In bonding and spacing a thin diaphragm from an electrode of the invention, it has been discovered that the bonding and spacing material is preferably an elastomeric, nonconductive material. When rigid nonconductive spacing and bonding materials were used, the diaphragm underwent significant stress and was subject to tearing after extended use. The use of the elastomeric bonding and spacing material allows the diaphragm to function for an extended period of time without deterioration.

In accordance with yet another aspect of the invention, there is provided an embodiment whereby a plurality of electrostatic audio transducers of the invention are fabricated side by side to form a larger unit with increased audio power.

By using the novel electrostatic audio transducer electrode of the invention, an electrostatic audio transducer is obtained which is free from internally generated sparks, has rapid recovery from transient voltage overloads, provides a uniform electric field within the transducer, has a relatively small air gap with concomitant acoustic efficiency, and enables the fabrication of electrostatic audio transducers having multiple audio generating diaphragms.

By using an electrode of the invention having a dielectric layer on each side covering a conductive layer on each side, it is possible to fabricate a multiple diaphragm electrostatic audio transducer having excellent audio performance characteristics.

By employing an electrode of the invention having formed holes of smaller diameter than and concentric with the etched holes in the conductive layer, the conductor is adequately insulated at the hole edges to prevent sparking from the edge of the conductor through the hole to the diaphragm or opposite electrode.

A more uniform electric field is provided throughout the transducer by the effect of a high dielectric constant layer which extends beyond the edge of the conductive layer. Without the dielectric layer, the electric field would tend to fringe and get weaker at the edge of the conductive layer.

Another benefit of the invention is the provision of a speaker having multiple diaphragms. Still another benefit of the invention is a speaker having a plurality of electrostatic audio transducers placed side by side to provide an audio speaker with increased audio power.

BRIEF DESCRIPTION OF THE DRAWINGS

The foregoing and other objects, features, and advantages of the invention will be apparent from the more specific description of preferred embodiments of the invention, as illustrated in the accompanying drawings in which reference characters refer to the same parts throughout the different views. The drawings are not necessarily to scale, emphasis instead being placed upon illustrating principles of the invention in a clear manner.

FIG. 2 is an enlarged cross-sectional edge view showing details of the relationship of the elements of an electrode of the embodiment of FIG. 1;

FIG. 3 is a cross-sectional edge view of an embodiment of the invention showing resilient bonding and spacing elements for bonding plural electrodes to a diaphragm and for spacing the electrodes from the diaphragm;

FIG. 4C is a cross-sectional edge view of a multiple diaphragm electrostatic transducer having an electrical hook-up in a third configuration.

DETAILED DESCRIPTION OF THE INVENTION

Figure 1A:
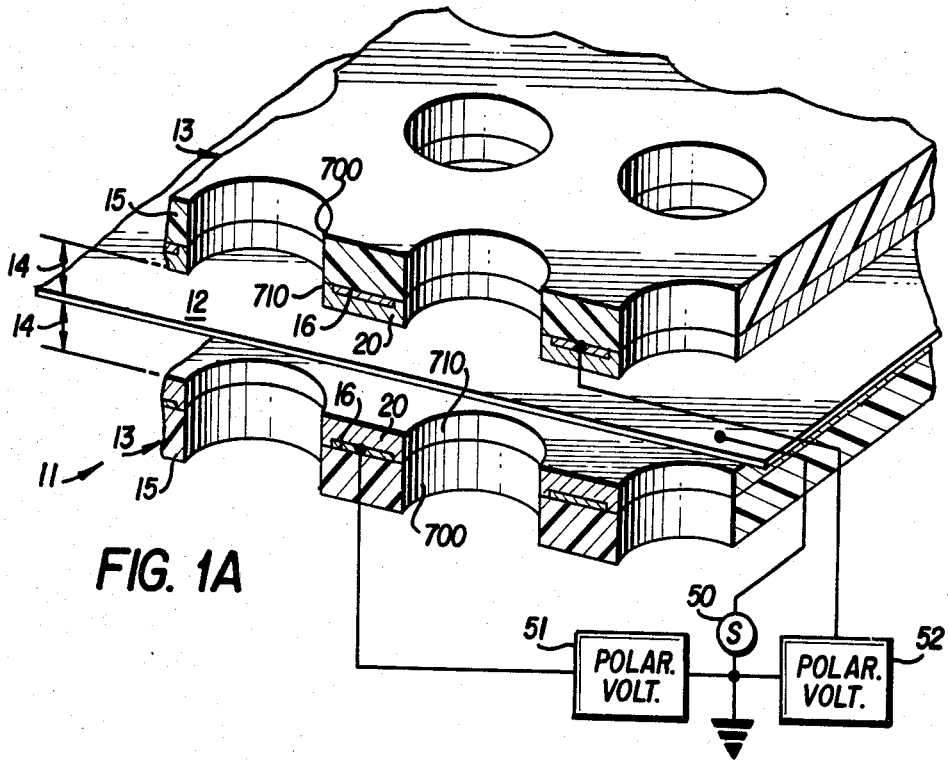
FIG. 1A is a cross-sectional perspective view of a portion of a single diaphragm electrostatic audio transducer of an embodiment of the invention.
Figure 1B:
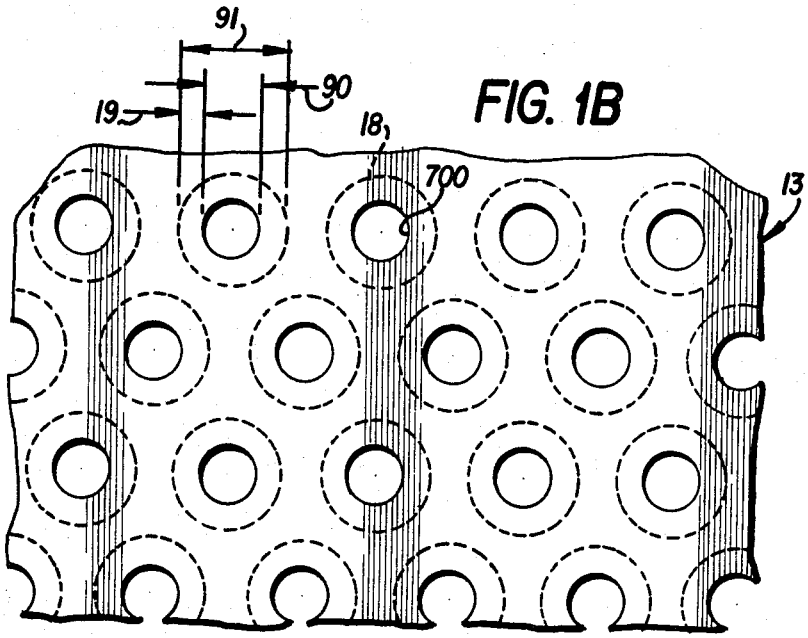
FIG. 1B is a front view of a portion of a single diaphragm electrostatic audio transducer of FIG. 1A.

Reference is now made to FIG. 1 which shows a partial cross-section of a constant voltage electrostatic audio transducer 11 comprised of a diaphragm 12 and electrodes 13, each of the electrodes 13 being spaced from diaphragm 12 by air gaps 14. Audio generator 50 generates the signals applied to diaphragm 12. Conventional polarizing voltage means 51 and 52 are used to charge electrodes 13 thereby creating an electric field therebetween.

Each electrode 13 is comprised of a nonconductive substrate 15 such as commonly employed in printed circuit boards. A layer of conductive coating 16 is provided on nonconductive substrate 15. Generally conductive layer 16 is a metal foil such as copper foil. Nonconductive substrates 15 have a plurality of holes or perforations 700 therethrough. The approximately 0.20 inch diameter of holes 700 is less than the approximately 0.250 inch diameter of etched holes 18 in conductive layers 16. In fact, the diameter of hole 700 (labeled as 90 in FIG. 2) is less than the diameter of hole 18 (labeled as 91 in FIG. 2) by an amount twice the radial length depicted in FIG. 2 by reference numeral 19. Reference numeral 19 thus represents the radial distance from the circumference of hole 700 to the circumference of concentric hole 18. A dielectric layer 20 is coated or laminated over conductive layer 16 and exposed substrate and, as seen hereinafter occupies space 19. The dielectric layer 20 has a plurality of formed holes 710 which are equal in diameter to holes 700 and thereby of less diameter than etched holes 18.

FIG. 2 shows that dielectric layer 20 is applied over conductive layer 16 and also extends to cover nonconductive layer 15 in space 19. If conductive layer 16 were to extend through recess 19 up to hole 710, sparking would occur due the poor insulation strength of air being exceeded. However, because conductive layer 16 is recessed from holes 700 and 710 by space 19, and the same dielectric layer 20 material is present on top of and to the side of conductive layer 16. The electric field between opposite electrodes 13 in a transducer 11 is uniform because the high dielectric constant material conducts the electric field at least out to the edges of the holes 700.

FIG. 3 depicts the structure and manner of bonding diaphragm 12 to electrodes 13 and spacing the electrodes 13 from diaphragm 12 to leave the air gap 14. Two quantities 25*a*, 25*b* of nonconductive and resilient spacing and bonding material 25 are employed. It is necessary that material 25 be nonconductive so that the voltage between electrodes 13 will not be shorted. It has been discovered that material 25 must be somewhat elastic to match the elasticity of the tightly stretched diaphragm material to avoid a progressive tearing away of the diaphragm. A suitable substance for serving as material 25 is a silicone rubber elastomer material such as GE silicone rubber adhesive sealant RTV 157.

In fabricating an electrostatic transducer 11 shown in FIG. 3, the following technique may be employed. Temporary rigid spacers 26*a* and 26*b* are used to space two electrodes 13 together while a tautly stretched diaphragm 12 is spaced therebetween in an alternate embodiment, the spaces 26*a* and 26*b* are bonded to the diaphragm 12. Quantities 25*a* and 25*b* of a viscous uncured elastomer are applied to sandwich the diaphragm 12 therebetween and to bond the diaphragm 12 to electrodes 13. After the adhesive has cured to form a solid elastomer, the temporary spacers 26*a* and 26*b* and the portions of electrodes 13 bonded thereto may be removed by cutting these portions away from the remaining portions bonded by means of the solidified elastomer. The portions to be cut away are indicated by the dotted lines in FIG. 3. After the rigid spacers are removed, electrodes 3 are spaced and bonded by elastomer materials 25*a* and 25*b*.

The thickness of the temporary rigid spacers 26*a* and 26*b* is selected to provide a desired predetermined air gap 14.

Figure 4B:
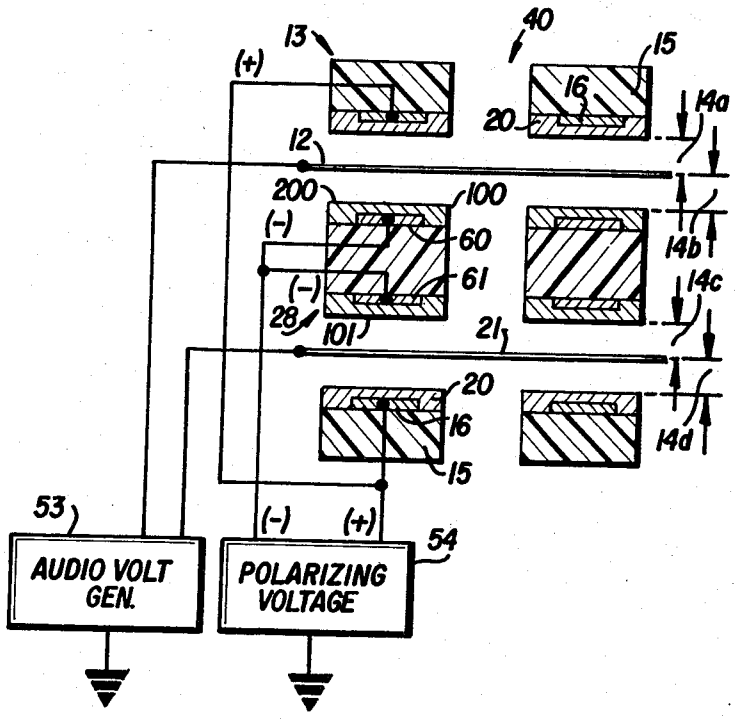
FIG. 4B is a cross-sectional edge view of a multiple diaphragm electrostatic transducer having an electrical hook-up in a second configuration.

A multiple diaphragm embodiment of the invention is shown in FIG. 4. Herein electrodes 13 and 30, each having a single conductive layer 16 and a single dielectric layer 20, are at the top and bottom, respectively, of a multiple diaphragm electrostatic audio transducer 40. First diaphragm 12 is spaced from electrode 13 by air gap 14*a*.

Spaced from first diaphragm 12 by air gap 14*b* is an electrode 28 made in accordance with the invention which has two conductive layers 60 and 61 coated with two dielectric layers 200 and 201, respectively. The recess spacing between holes 700 in the nonconductive substrate 15 and the holes 18 in conductive layers 60 and 61 is similar to the recess spacing 19 described above with reference to the embodiment of FIGS. 1 and 2.

Adjacent the dielectric layer 201 of double conductor electrode 18 and spaced therefrom by air gap 14*c* is second diaphragm 21. Second diaphragm 21 is spaced from electrode 30 by air gap 14*d*. It is understood that multiple diaphragms 12 and 21 are bonded to and spaced from electrodes 13, 28, and 30 by the afore-discussed resilient elastomeric spacing and bonding material 25 (not shown). Conventional elements and circuitry 54 for applying polarizing voltage to the electrodes and conventional circuitry 53 for applying audio frequency voltage electrical signals to the diaphragms are shown as block symbols.

Figure 4A:
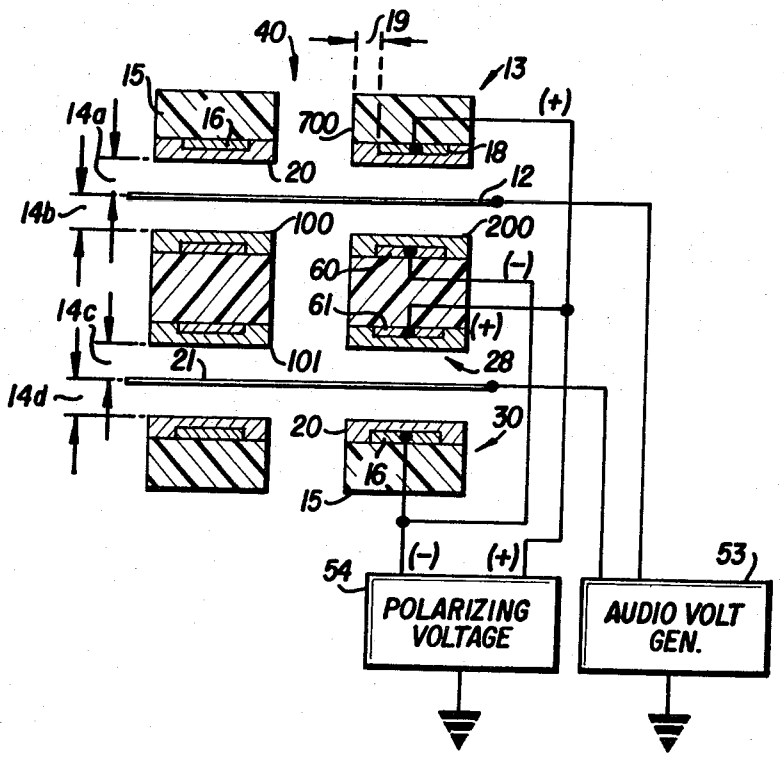
FIG. 4A is a cross-sectional edge view of a multiple diaphragm electrostatic transducer of an embodiment of the invention having an electrical hookup in a first configuration.

In the electrical hook-up configuration for a multiple diaphragm transducer shown in FIG. 4A, conductive layers 16 in electrode 13 and layers 61 in electrode 28 are positively charged, and while conductive layers 60 in electrode 28 and layers 16 in electrode 30 are negatively charged, and the diaphragms 12 and 21 are driven by the audio electrical signal generator 53 in phase. In the electrical hook-up configuration for the multiple diaphragm transducer shown in FIG. 4B, on the other hand, conductive layers 16 in electrodes 13 and 30 are positively charged, while conductive layers 60 and 61 in electrode 28 are negatively charged. The phase of audio electric signals driving multiple diaphragms 12 and 21 must be reversed to change from the hook-up configuration of FIG. 4A to the configuration of FIG. 4B. Sandwiching the conductors within the electrodes provides the capability of alternate hook-up arrangements due to the excellent insulation characteristics of the materials surrounding the conductive elements in each electrode.

In FIG. 4C an additional electrical hook-up configuration is shown for a multiple diaphragm transducer. In this embodiment, electrodes 13 and 28 on either side of diaphragm 12 are hooked-up so that conductive layers 16 and 60 are at the same D.C. potential such as negative as shown. An opposite polarizing potential, in this case positive, is applied to the diaphragm 12 which has high resistance conductive coatings applied on each side of the diaphragm. An audio signal is applied to diaphragm 12. Electrodes 28 and 30 are hooked-up so that conductive layers 61 and 16 on electrode 30 are at the same D.C. potential such as positive as shown which is opposite to the potential applied to conductive layers 16 on electrode 13 and 60 on electrode 28. A polarizing voltage, in this case negative, is applied to the diaphragm 21 which is between conductive layers 61 and 16 on electrode 30. The audio signals which are applied to diaphragms 12 and 21 and which modulate the polarizing voltages of the diaphragms are the same signal except that they are out of phase. The polarizing voltages on diaphragms 12 and 21 are opposite so that the forces on diaphragms 12 are not in the same direction as the forces on diaphragm 21.

Figure 5A:
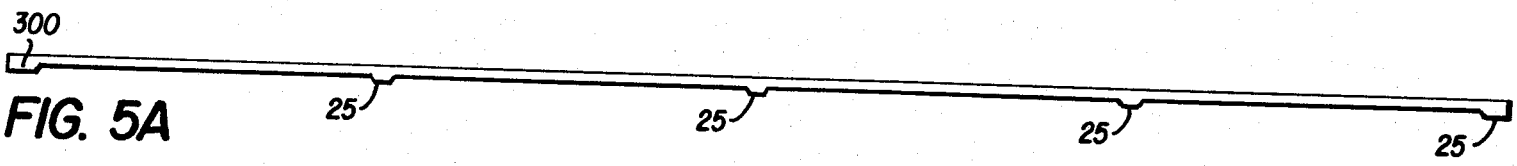
FIG. 5A is a top view of an electrode of an embodiment of the invention suitable for use with an electrostatic audio transducer.

In FIG. 5A, an electrode 300 is formed in accordance with another embodiment of the invention with a plurality of air gap spacers 25 integrally cast into or otherwise secured to the electrode 300.

Figure 5B:
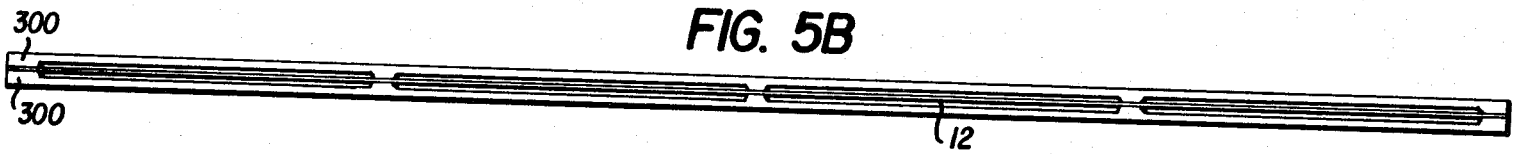
FIG. 5B is a top view of an electrostatic transducer of an embodiment of the invention which utilizes the electrode of FIG. 5A; and, FIG. 5C is a front view of the transducer of FIG. 5B.

FIG. 5B shows an electrostatic audio transducer in accordance with an embodiment of the invention having a top electrode 300 and bottom electrode 300 with a diaphragm 12 spaced therebetween. The embodiment of the invention shown in FIG. 5B may be fabricated in a manner similar to the embodiment shown and described with reference to FIG. 3 employing temporary spacers which can be cut off after elastomeric material 25 is cured. In the illustrated embodiment, the elastomeric material is a bead approximately 30 mils thick and about 0.2 inches wide. A suitable material for spacing and bonding material 25 is a GE silicon rubber adhesive sealant RTV 157.

Figure 5C:
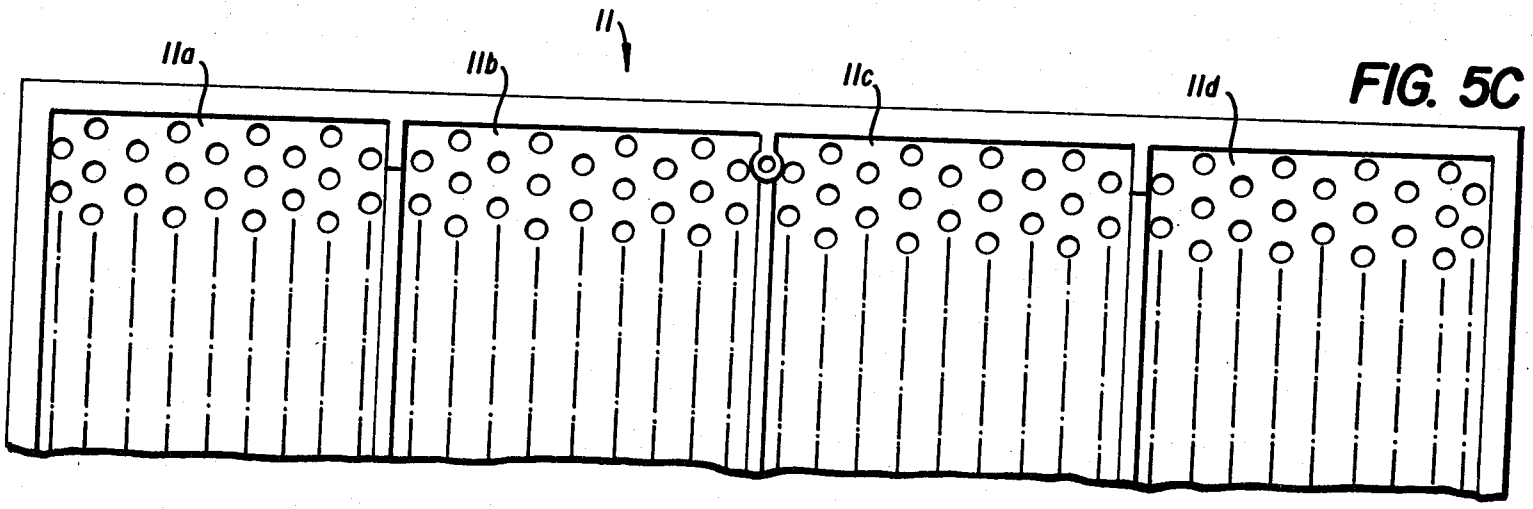

FIG. 5C shows a front view of the embodiment of the invention shown in FIGS. 5A and 5B. The overall transducer 11 is comprised of component transducers 11*a*, 11*b*, 11*c*, and 11*d*.

Dielectric layer 20 may be applied to the conductive layer 16 and nonconductive substrate 15 by any suitable means such as, including but not limited to, lamination of a film of dielectric material 20, spraying on a solution of dissolved dielectric material with subsequent drying of solvent to form a film, or painting on a liquid coating which dries and forms a solid film.

In a preferred method of applying the dielectric layer 20, a layer of dielectric material is applied to a previously conductively coated and etched nonconductive substrate such as a printed circuit board, and a hydraulic press having a heated platen is used to laminate the dielectric layer onto the printed circuit board. The platen is heated to a temperature at which the dielectric layer is caused to flow. In a preferred embodiment, the platen is heated to approximately 360° F.—the temperature at which nylon, the preferred dielectric, is caused to flow. The flowing nylon completely fills the space between the printed circuit board and the platen to provide an electrode having a dielectric layer with an essentially flat upper surface 35 as shown in FIG. 2. Preferably, a stainless steel platen is used with a thin film of non-stick material such as Tedlar.

As mentioned above, the dielectric material 20 preferably has a volume resistivity of about $10^{11}$ ohms-cm. The preferred material is a polyamide resin such as nylons 11 and 12 which are plasticized to bring down volume resistivity. Preferred stock nylon materials for forming dielectric layer 20 are comprised of pellets obtained from the Rilson Co. and have stock labels AESNO P40 TL (nylon 11) and BESNO P40 (Nylon 12). The dielectric constant of the preferred material is approximately 10. The preferred nylon is relatively impervious to moisture and can be laminated. The preferred thickness of the lamination is approximately 10 mils.

Data from *Lange's Handbook of Chemistry,* 11th ed., 1973, pages 7-453 through 7-454 indicate that the following classes of thermoplastic materials may have volume resistivity of $10^{11}$ ohm cm and may therefore by suitable for dielectric material 20: polyvinyl chloride (PVC); cellulose nitrate; cellulose acetate; and, cellulose acetate butyrate.

In construction of an electrostatic audio transducer in accordance with the invention, the provision of a small air gap between the diaphragm 12 and the electrodes 13 is desirable. As mentioned above, the amplifier power to drive the electrostatic transducer is proportional to the air gap spacing. It has been found that if 100 watts is required for a 30 mil air gap thickness, 400 watts is required for 120 mil gap air thickness. The novel electrostatic audio transducer is excellently suited for use with small air gap thicknesses.

It is understood that although the multiple diaphragm embodiments disclosed herein have two diaphragms, multiple diaphragm embodiments employing three or more diaphragms may be obtained by employing the principles of the invention.

Although the descriptions have set forth embodiments directed to use of the novel electrode in a novel electrostatic transducer for generating audio power, the principles of both the electrode and the electrostatic transducer employing the electrode therein may be applied to electrostatic transducers for frequency ranges both above and below the audio range. Modifications of air gap, volume resistivity of dielectric material, and other suitable modifications would be apparent to one with ordinary skill in the art employing principles of the inventions described herein.

The foregoing description of the novel electrode of the invention, and the novel electrostatic audio transducer employing the electrode of the invention, and the methods of manufacture has been presented for purposes of illustration and description. It is not intended to be exhaustive or to limit the invention to the precise forms disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

The embodiments of the invention in which an exclusive property or privilege is claimed are defined by the following:

1. An electrode for use in an electrostatic transducer, comprising:

planar nonconductive means having a plurality of first holes;

a conductive layer on a first side of said planar member, said conductive layer having a plurality of second holes; and a dielectric layer having a volume resistivity of not more than $10^{13}$ ohm cm on said first side of said planar member to sandwich said conductive layer between said planar member and said dielectric layer, said dielectric layer having a plurality of third holes.

2. An electrode as described in claim 1 wherein said dielectric layer has a volume resistivity of no more than $10^{11}$ ohm cm.

3. An electrode as described in claim 1 wherein said dielectric layer is comprised of a polyamide material.

4. An electrode as described in claim 3 wherein said dielectric layer is comprised of nylon.

5. An electrode as described in claim 1 wherein said dielectric layer is in a range from 3–15 mils thick and is laminated onto said conductive layer and said first planar member.

6. An electrode as described in claim 1 wherein said first holes are concentric with said second holes, and wherein said first holes in said planar nonconductive means are of smaller diameter than said second holes in said conductive layer.

7. An electrode as described in claim 1 wherein said conductive layer is comprised of copper.

8. An electrode as described in claim 1, further comprising:

a second conductive layer on a second side of said planar member; and a second dielectric layer having a volume resistivity of not more than $10^{13}$ ohm cm covering said second side of said planar member.

9. An electrostatic transducer, comprising:

first and second electrodes, each electrode being comprised of: planar nonconductive means having a plurality of first holes; a conductive layer on a first side of said planar member, said conductive layer having a plurality of second holes; and, a dielectric layer having a volume resistivity of not more than $10^{13}$ ohm cm on said first side of said planar member to sandwich said conductive layer between said planar member and said dielectric layer, said dielectric layer having a plurality of third holes;

diaphragm means bonded to and spaced from said first and second electrodes; and nonconductive bonding and spacing means for bonding and spacing said diaphragm means to and between said first and second electrodes.

10. An electrostatic transducer as described in claim 9 wherein said bonding and spacing means is comprised of an elastomeric material.

11. An electrostatic transducer as described in claim 10 wherein said bonding and spacing elastomeric material is a silicone rubber.

12. An electrostatic transducer as described in claim 9 wherein said diaphragm is coated with a conductive coating.

13. An electrostatic transducer as described in claim 12 wherein said diaphragm is comprised of aluminized Mylar.

14. An electrostatic transducer as described in claim 12 wherein said diaphragm has a high resistance coating thereon.

15. An electrostatic transducer as described in claim 9 wherein said dielectric layer has a volume resistivity of not more than $10^{11}$ ohm cm.

16. A multiple diaphragm electrostatic transducer comprising:

a first electrode having a nonconductive substrate with one side coated first with a conductive layer and next coated with a dielectric layer having a volume resistivity of not more than $10^{13}$ ohm cm;

a first diaphragm bonded to and spaced from said first electrode;

a second electrode bonded to and spaced from said first diaphragm, said second electrode having a nonconductive substrate with each of two sides first coated with a conductive layer and next coated with a dielectric layer having a volume resistivity of not more than $10^{13}$ ohm cm;

a second diaphragm bonded to and spaced from said second electrode; and, a third electrode bonded to and spaced from said second diaphragm, said third electrode having a nonconductive substrate with one side first coated with a conductive layer and next coated with a dielectric layer having a volume resistivity of not more than $10^{13}$ ohm cm.

17. A multiple diaphragm electrostatic transducer as described in claim 16 wherein said dielectric layer has a volume resistivity of not more than $10^{11}$ ohm cm.

18. An electrode for use in an electrostatic transducer, comprising:

planar nonconductive means having a plurality of first holes;

a conductive layer on a first side of said planar member, said conductive layer having a plurality of second holes; and a dielectric layer on said first side of said planar member to sandwich said conductive layer between said planar member and said dielectric layer, said dielectric layer having a plurality of third holes;

wherein said dielectric layer is made from material selected from the group consisting of polyamide, polyvinylchloride, cellulose nitrate, cellulose acetate, or cellulose acetate butyrate.

19. An electrode as described in claim 18 wherein said polyamide is a nylon.

20. An electrostatic transducer, comprising:

first and second electrodes, each electrode being comprised of: planar nonconductive means having a plurality of first holes; a conductive layer on a first side of said planar member, said conductive layer having a plurality of second holes; and, a dielectric layer on said first side of said planar member to sandwich said conductive layer between said planar member and said dielectric layer, said dielectric layer having a plurality of third holes;

diaphragm means bonded to and spaced from said first and second electrodes; and nonconductive bonding and spacing means for bonding and spacing said diaphragm means to and between said first and second electrodes;

wherein said dielectric layer is made from material selected from the group consisting of polyamide, polyvinylchloride, cellulose nitrate, cellulose acetate, or cellulose acetate butyrate.

21. An electrostatic transducer as described in claim 20 wherein said polyamide is a nylon.

22. A multiple diaphragm electrostatic transducer comprising:

a first electrode having a nonconductive substrate with one side coated first with a conductive layer and next coated with a dielectric layer;

a first diaphragm bonded to and spaced from said first electrode;

a second electrode bonded to and spaced from said first diaphragm, said second electrode having a nonconductive substrate with each of two sides first coated with a conductive layer and next coated with a dielectric layer;

a second diaphragm bonded to and spaced from said second electrode; and a third electrode bonded to and spaced from said second diaphragm, said third electrode having a nonconductive substrate with one side first coated with a conductive layer and next coated with a dielectric layer;

wherein said dielectric layers are made from materials selected from the group consisting of polyamide, polyvinylchloride, cellulose nitrate, cellulose acetate, or cellulose acetate butyrate.

23. A multiple diaphragm electrostatic transducer as described in claim 22 wherein said polyamide is a nylon.

* * * * *